US007494388B2

(12) United States Patent
Kakuta

(10) Patent No.: US 7,494,388 B2
(45) Date of Patent: Feb. 24, 2009

(54) TERMINAL FITTING HAVING BI-METALLIC CAULKING PIECES

(75) Inventor: Naoki Kakuta, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/745,628

(22) Filed: May 8, 2007

(65) Prior Publication Data

US 2007/0264873 A1 Nov. 15, 2007

(30) Foreign Application Priority Data

May 10, 2006 (JP) ..... 2006-130986

(51) Int. Cl.
*H01R 4/10* (2006.01)

(52) U.S. Cl. ..... 439/879; 439/877; 439/880; 439/887

(58) Field of Classification Search ..... 439/877–879, 439/851, 842–843, 880, 887
See application file for complete search history.

(56) References Cited

U.S. PATENT DOCUMENTS 3,732,528 A * 5/1973 Vetter ..... 439/489
7,115,004 B2 * 10/2006 Takayama ..... 439/852
7,252,559 B1 * 8/2007 Morello et al. ..... 439/843

FOREIGN PATENT DOCUMENTS

JP 56-48079 A 5/1981
JP 4-209471 A 7/1992

* cited by examiner

*Primary Examiner*—Renee Luebke
*Assistant Examiner*—Vanessa Girardi
(74) *Attorney, Agent, or Firm*—Sughrue Mion, PLLC

(57) ABSTRACT

An aluminum (Al) terminal has a first bottom wall, and a pair of caulking pieces that are stood from the first bottom wall and caulked in a state where the first bottom wall covers a wire connection portion with the core wires arranged on the upper side from the underside. Thereby, the Al terminal made of Al or Al alloy can be crimped from outside the terminal fitting main body made of copper or copper alloy, and the spring back of the terminal fitting main body made of copper or copper alloy can be suppressed by the Al terminal.

3 Claims, 10 Drawing Sheets

TERMINAL FITTING HAVING BI-METALLIC CAULKING PIECES

BACKGROUND OF THE INVENTION

1. Field of the Invention

The present invention relates to a terminal fitting and a mounting method, and more particularly to a terminal fitting that is mounted on the core wires made of aluminum or aluminum alloy and its mounting method.

2. Related Art

Various kinds of electronic devices are mounted on an automobile as a mobile unit. The automobile has arranged a wire harness for passing electric power through a wire from a battery etc. or a control signal from a control unit to the electronic devices. The wire harness comprises an electric wire and a connector. The connector comprises a housing formed of synthetic resin having insulating property and a terminal fitting accommodated within the housing and mounted at the terminal of the electric wire.

One example of the terminal fitting is shown in FIG. 10. FIG. 11 is a perspective view showing a state where the terminal fitting as shown in FIG. 10 is mounted on the electric wire. FIG. 12 is a cross-sectional view of FIG. 11, taken along the line III-III. The electric wire 10 comprises a plurality of core wires 11 and a sheath portion 12 for covering the core wires 11, as shown in FIG. 11. The terminal fitting 20 is obtained by bending a conductive sheet metal, and comprises an electric contact portion 21 for connecting the mating terminal fitting and a wire connection portion 22 for connecting the electric wire 10, as shown in FIG. 10.

The electric contact portion 21 comprises a rectangular barrel portion 23, and a spring piece, not shown, accommodated within the barrel portion 23. The barrel portion 23 is formed like a rectangular barrel in the shown example. The spring piece urges an inserter such as a male tab of the mating terminal fitting entered into the barrel portion 23 toward the inner surface of the barrel portion 23, and pinches the inserter with the inner surface. The electric contact portion 21 is connected with the mating terminal fitting electrically and mechanically, because the inserter such as the male tab of the mating terminal fitting is inserted into the barrel portion 23 and the spring piece pinches the inserter with the inner surface of the barrel portion 23.

The electrical connection portion 22 comprises a bottom wall 24 having an arcuate section, a pair of core wire caulking pieces 25, and a pair of sheath portion caulking pieces 26. The bottom wall 24 is continuous with an external wall of the barrel portion 23. The pair of core wire caulking pieces 25 and the pair of sheath portion caulking pieces 26 are stood from the bottom wall 24.

If the pair of core wire caulking pieces 25 are caulked in a state where the core wires 11 of the electric wire 10 are positioned on the bottom wall 24 between the pair of core wire caulking pieces 25, the core wires 11 of the electric wire 10 are crimped with the pair of core wire caulking pieces 25, as shown in FIG. 11. Also, if the pair of sheath portion caulking pieces 26 are caulked in a state where the core wires 12 of the electric wire 10 are positioned on the bottom wall 24 between the pair of sheath portion caulking pieces 26, the sheath portion 12 of the electric wire 10 is mounted on the pair of sheath portion caulking pieces 26, as shown in FIG. 11.

Copper or copper alloy that has excellent spring property and conductivity is typically used for the terminal fitting 20 having the spring piece, as described above. On the other hand, the copper wire that has excellent conductor property is typically used as the material of the core wires 11 of the electric wire 10.

By the way, the automobile as the mobile unit having the multi-function is asked by users. Therefore, the automobile tends to mount more electronic devices. Therefore, the electric wire 10 of the wire harness naturally increases, so that the mass and volume of the wire harness tend to increase.

Therefore, to reduce the size and weight of the wire harness, aluminum that has excellent conductor property and has one-third the specific weight of copper has begun to be used as the material of the core wires 11 of the electric wire 10. On the other hand, since the terminal fitting 20 has the spring piece as described above, there has been a demand for directly using the material of copper or copper alloy having excellent spring property.

However, copper or copper alloy has a greater spring back property than aluminum or aluminum alloy. Therefore, if the terminal fitting 20 made of copper or copper alloy is caulked to crimp the core wires 11 made of aluminum or aluminum alloy, the core wires are placed in a loose crimped state, whereby there was a problem that the contact resistance value at the crimped part increased to cause an imperfect contact. (See for example, JP-A-4-209471 and JP-A-56-48079.)

SUMMARY OF THE INVENTION

Thus, in the light of the above-mentioned problem, it is an object of the invention to provide a terminal fitting that can securely mount the core wires made of aluminum or aluminum alloy for the electric wire by suppressing the contact resistance at the crimped part and its mounting method.

In order to accomplish the above object, the first aspect of the invention resides in a terminal fitting comprising:

a terminal fitting main body made of copper or copper alloy having a wire connection portion for connecting a core wire made of aluminum or aluminum alloy and an electric contact portion for connecting a mating terminal fitting; and an aluminum terminal made of aluminum or aluminum alloy for caulking the wire connection portion and the core wire, the aluminum terminal including a first bottom wall, and a first pair of caulking pieces that are stood from the first bottom wall, wherein the aluminum terminal is caulked such that the core wire is arranged on an upper side of the wire connection portion and the first bottom wall covers the wire connection portion from a lower side thereof.

With the first aspect of the invention, the aluminum terminal made of aluminum or aluminum alloy can be crimped from outside the terminal fitting main body made of copper or copper alloy, and the spring back of the terminal fitting main body made of copper or copper alloy can be suppressed by the aluminum terminal to improve a contact pressure between the aluminum terminal, the terminal fitting main body and the core wires. Since the core wires made of aluminum or aluminum alloy and the aluminum terminal have the roughly same spring back property, it is possible to attain the high contact pressure at the part where the aluminum terminal and the core wires are directly crimped.

The second aspect of the invention resides the wire connection portion includes a second bottom wall on which the core wire is arranged, and a second pair of caulking pieces that are stood from the second bottom wall and has a lower height than the first pair of caulking pieces, and the aluminum terminal is caulked such that the second pair of caulking pieces are pinched between the first pair of caulking pieces.

With the second aspect of the invention, the ends of the first caulking pieces away from the first bottom wall provided in the aluminum terminal can bite into the aluminum core wire, forming an interference fit structure.

The third aspect of the invention provides a mounting method for mounting a core wire on a terminal fitting main body made of copper or copper alloy having a wire connection portion for connecting the core wire made of aluminum or aluminum alloy and an electric contact portion for connecting a mating terminal fitting, using an aluminum terminal made of aluminum or aluminum alloy having a first bottom wall and a first pair of caulking pieces stood from the first bottom wall, including:

a step of arranging the core wire on an upper side of the wire connection portion;

a step of covering a back face of the wire connection portion with the first bottom wall of the aluminum terminal; and a step of caulking the pair of caulking pieces such that the first bottom wall covers the wire connection portion from a lower side of the wire connection portion.

With the third aspect of the invention, the aluminum terminal made of aluminum or aluminum alloy can be crimped from outside the terminal fitting main body made of copper or copper alloy, and the spring back of the terminal fitting main body made of copper or copper alloy can be suppressed by the aluminum terminal, thereby improving a contact pressure between the aluminum terminal, the terminal fitting main body and the core wires. Since the core wires made of aluminum or aluminum alloy and the aluminum terminal have the roughly same spring back property, it is possible to attain the high contact pressure at the part where the aluminum terminal and the core wires are directly crimped.

As described above, with the invention, the aluminum terminal made of aluminum or aluminum alloy can be crimped from outside the terminal fitting main body made of copper or copper alloy, and the spring back of the terminal fitting main body made of copper or copper alloy can be suppressed by the aluminum terminal, thereby improving a contact pressure between the aluminum terminal, the terminal fitting main body and the core wires. Since the core wires made of aluminum or aluminum alloy and the aluminum terminal have the roughly same spring back property, it is possible to attain the high contact pressure at the part where the aluminum terminal and the core wires are directly crimped. Therefore, the core wires made of aluminum or aluminum alloy for the electric wire can be securely mounted by suppressing the contact resistance at the crimped part.

With the second aspect of the invention, the ends of the first caulking pieces away from the first bottom wall provided in the aluminum terminal can bite into the aluminum core wire, forming an interference fit structure. Therefore, the core wires made of aluminum or aluminum alloy for the electric wire can be securely mounted by suppressing the contact resistance at the crimped part.

With the third aspect of the invention, the spring back of the terminal fitting main body made of copper or copper alloy is securely suppressed, and the contact are a between the aluminum terminal and the terminal fitting main body and the terminal fitting main body and the core wires can be increased. Therefore, the core wires made of aluminum or aluminum alloy for the electric wire can be securely mounted by suppressing the contact resistance at the crimped part.

DETAILED DESCRIPTION OF THE PREFERRED EMBODIMENTS

Figure 1:
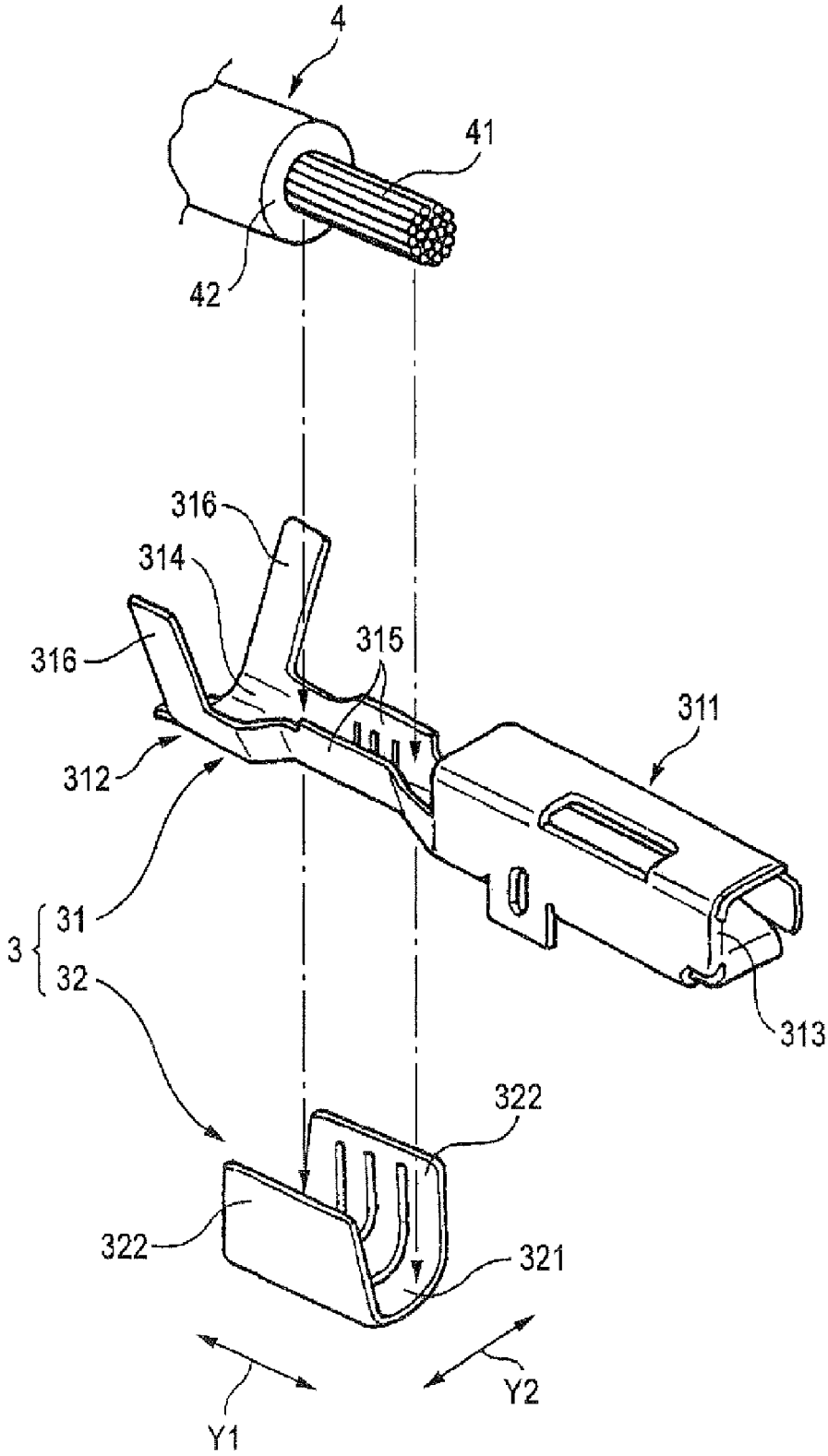
FIG. 1 is a perspective view showing a terminal fitting and an electric wire mounted on this terminal fitting according to the present invention.
Figure 2:
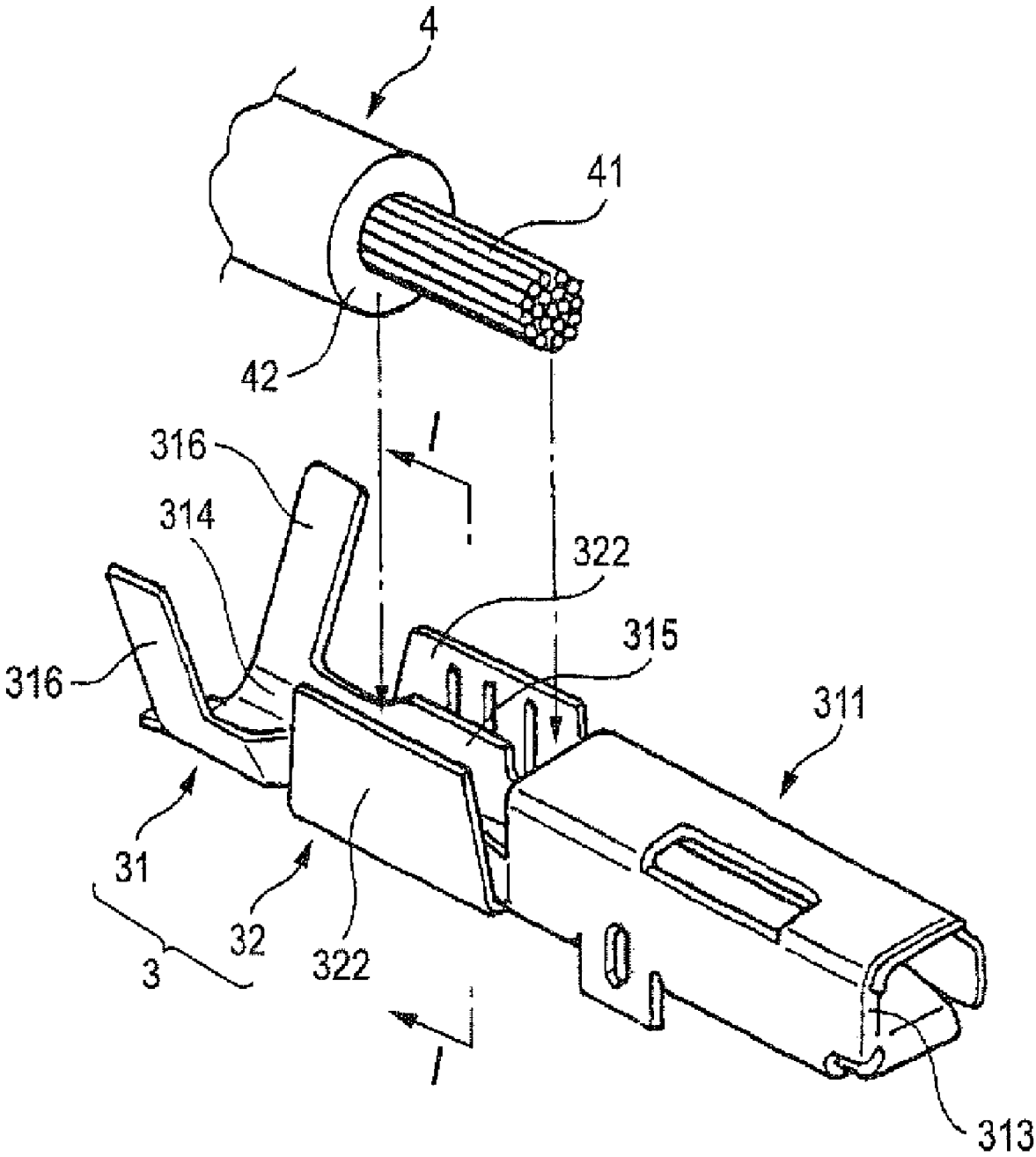
FIG. 2 is a perspective view showing a state where a terminal fitting main body is positioned at an aluminum terminal in FIG. 1.
Figure 3:
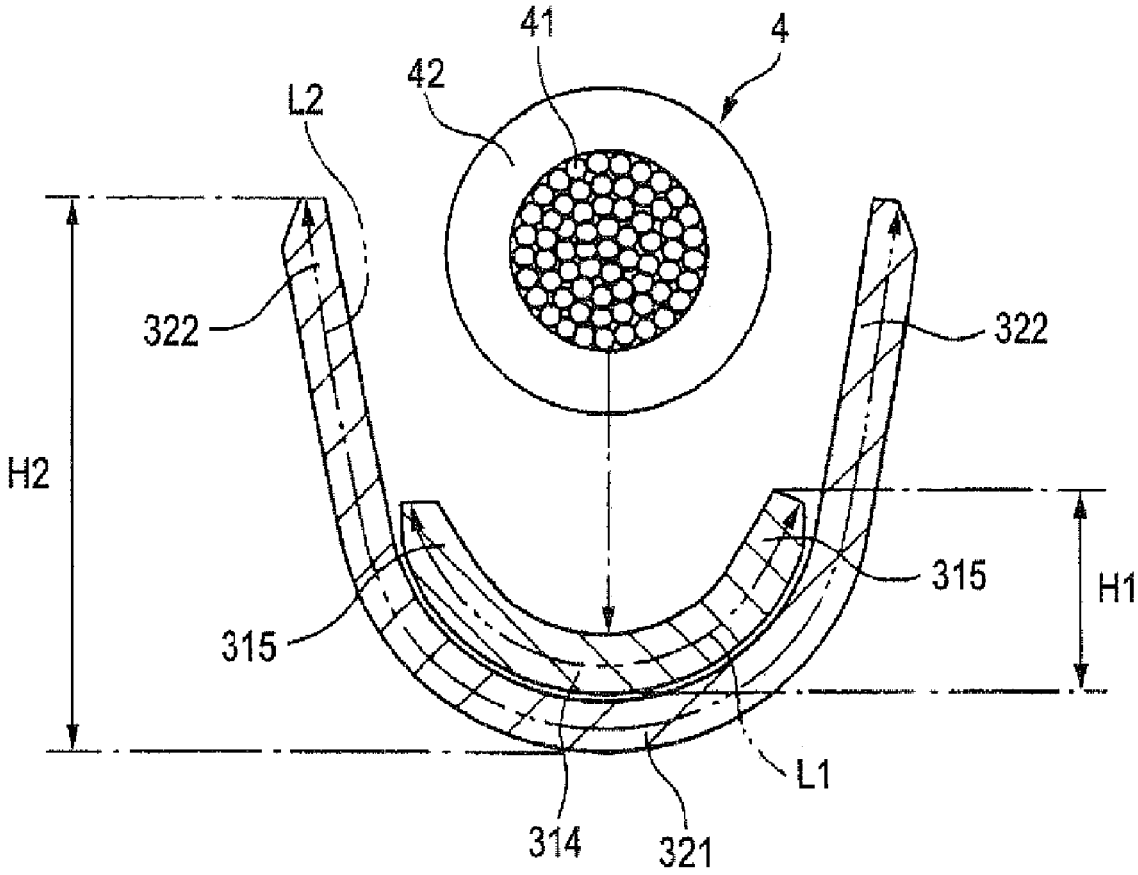
FIG. 3 is a cross-sectional view of the terminal fitting and the electric wire as shown in FIG. 2, taken along the I-I line.
Figure 4:
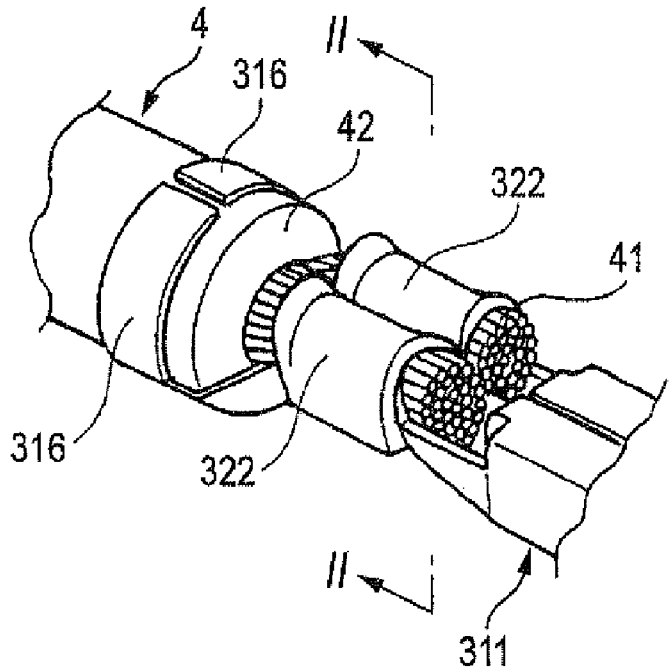
FIG. 4 is a perspective view showing a state where the caulking pieces of the Al terminal as shown in FIG. 2 are caulked.
Figure 5:
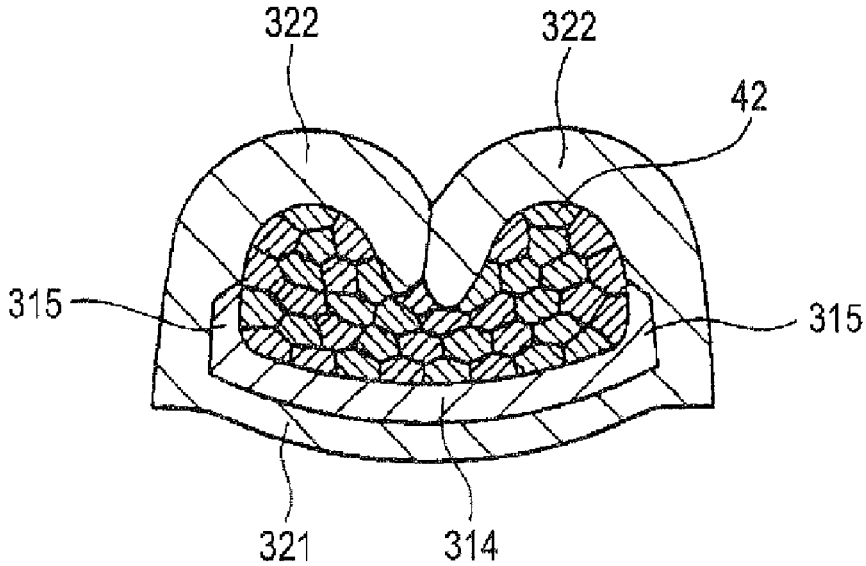
FIG. 5 is a cross-sectional view of the terminal fitting and the electric wire as shown in FIG. 4, taken along the line II-II.

One embodiment of the present invention will be described below with reference to the drawings. FIG. 1 is a perspective view showing a terminal fitting 3 and an electric wire 4 mounted on this terminal fitting 3 according to the invention. FIG. 2 is a perspective view showing a state where a terminal fitting main body 31 is positioned in an aluminum (herein after abbreviated as Al) terminal 32 in FIG. 1. FIG. 3 is a cross-sectional view of the terminal fitting 3 and the electric wire 4, taken along the line I-I as shown in FIG. 2. FIG. 4 is a perspective view showing a state where the caulking pieces 322 of the Al terminal 32 as shown in FIG. 2 are caulked. FIG. 5 is a cross-sectional view of the terminal fitting 3 and the electric wire 4, taken along the line II-II as shown in FIG. 4.

Figure 6:
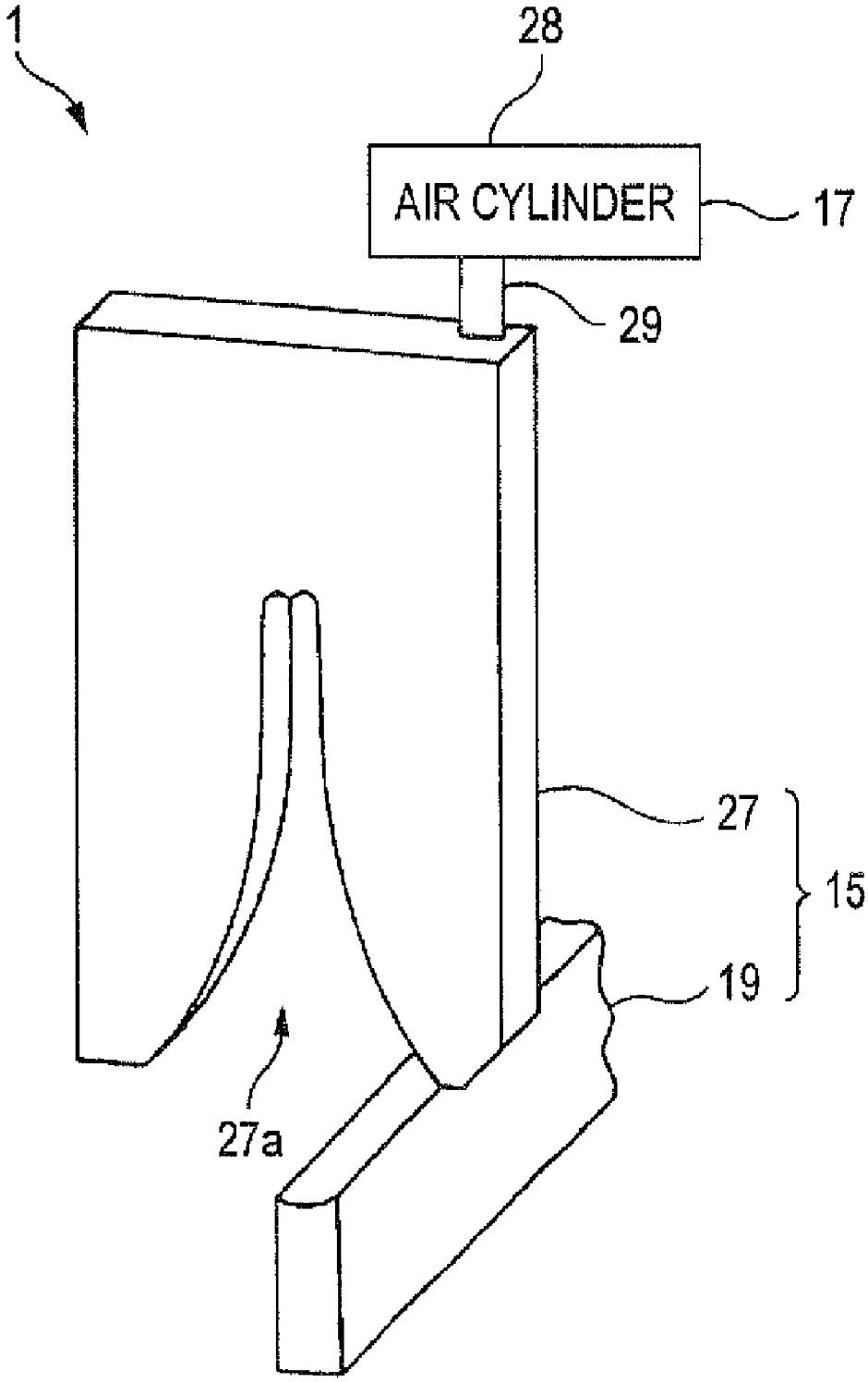
FIG. 6 is one example of a crimping device for crimping the terminal fitting and the Al core wires as shown in FIG. 1.
Figure 7:
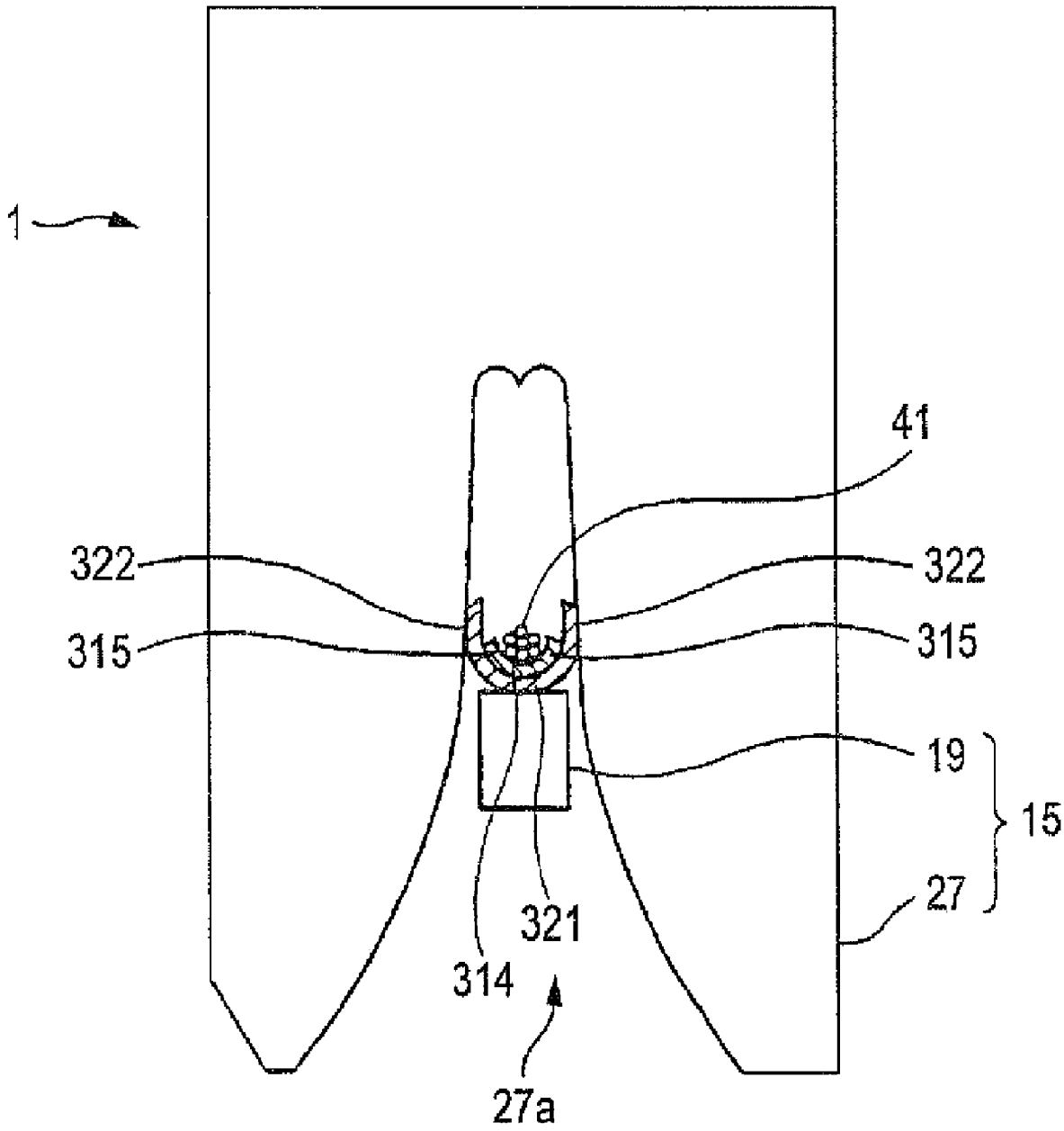
FIG. 7 is an explanatory view showing a state where an anvil and a crimper approach each other as shown in FIG. 6.

FIG. 6 is one example of a crimping device 1 for crimping the terminal fitting 3 and the Al core wire 41 as shown in FIG. 1. FIG. 7 is an explanatory view showing a state where an anvil 19 and a crimper 27 as shown in FIG. 6 approach each other.

The electric wire 4 comprises a plurality of Al core wires 41 and a sheath portion 42 for covering the Al core wires 41, as shown in FIG. 1. The Al core wires 41 (=core wires) are made of Al or Al alloy. The Al core wires 41 are formed like a circular arc in cross section.

The sheath portion 42 is made of synthetic resin having insulating property. The sheath portion 42 covers the plurality of Al core wires 41. The electric wire 4 has the Al core wires 41 exposed with the sheath portion 42 removed at its termination.

The terminal fitting 3 comprises a terminal fitting main body 31 and an Al terminal 32 separately. The terminal fitting main body 31 is made of copper or copper alloy. The terminal fitting main body 31 is obtained by bending a sheet metal made of copper or copper alloy, and comprises an electric contact portion 311 for connecting the mating terminal fitting, and a wire connection portion 312 for connecting the Al core wires 41 of the electric wire 4, as shown in FIG. 1.

The electric contact portion 311 comprises a rectangular barrel portion 313, and a spring piece, not shown, accommodated within the barrel portion 313. The barrel portion 313 is formed like a rectangular barrel in the shown example. The spring piece urges an inserter such as a male tab of the mating terminal fitting entered into the barrel portion 313 toward the inner surface of the barrel portion 313, and pinches the inserter with the inner surface. The electric contact portion 311 is connected with the mating terminal fitting electrically and mechanically, because the inserter such as the male tab of the mating terminal fitting is inserted into the barrel portion 313 and the spring piece pinches the inserter with the inner surface of the barrel portion 313.

The electrical connection portion 312 comprises a bottom wall 314 having an arcuate section, a pair of core wire caulking pieces 315, and a pair of sheath portion caulking pieces 316 (FIG. 1), as shown in FIG. 3. The bottom wall 314 is continuous with an external wall of the barrel portion 313. The Al core wires 41 are arranged on the upper side of the bottom wall 314.

The pair of core wire caulking pieces 315 constitute a second pair of caulking pieces as defined in the claims. The bottom wall 314 constitutes a second bottom wall as defined in the claims. The core wire caulking pieces 315 are provided centrally in the longitudinal direction Y1 of the bottom wall 314. The core wire caulking pieces 315 are stood from both ends of the bottom wall 314 in the width direction Y2.

The sheath portion caulking pieces 316 are provided at the ends of the bottom wall 314 on the side away from the electric contact portion 311. The sheath portion caulking pieces 316 are stood from both ends of the bottom wall 314 in the width direction Y2. The sheath portion caulking pieces 316 pinch the sheath portion 42 of the electric wire 4 with the bottom wall 314 by bending their edges away from the bottom wall 314 in a direction closer to the bottom wall 314, as shown in FIG. 4. Thus, the sheath portion caulking pieces 316 caulk the sheath portion 42 of the electric wire 4.

The Al terminal 32 comprises a bottom wall 321 having arcuate section and a pair of caulking pieces 322, as shown in FIG. 3. The pair of caulking pieces 322 are stood from both ends of the bottom wall 321 in the width direction Y2. The bottom wall 321 covers the underside of the bottom wall 314 between the pair of core wire caulking pieces 315. That is, the bottom wall 312 covers the underside of the wire connection portion 312.

The core wire caulking pieces 315 have the height H1 to be lower than the height H2 of the caulking pieces 322, as shown in FIG. 3. The pair of caulking pieces 322 constitute a first pair of caulking pieces as defined in the claims. The bottom wall 321 constitutes a first bottom wall as defined in the claims.

Also, the pair of caulking pieces 322 are caulked in a state where the bottom wall 321 of the Al terminal 32 covers the bottom wall 314 of the terminal fitting main body 31 with the Al core wires 41 arranged on the upper side from the underside, and the pair of caulking pieces 315 are pinched between the pair of caulking pieces 322. The pair of caulking pieces 322 are folded at the edge on the side away from the bottom wall 321 in a direction closer to the bottom wall 321, thereby pinching the Al core wires 41 of the electric wire 4, the core wire caulking pieces 315 of the terminal fitting main body 31 and the bottom wall 314 with the bottom wall 321. Thus, the caulking pieces 322 can caulk the Al core wires 41 of the electric wire 4, the core wire caulking pieces 315 of the terminal fitting main body 31, and the bottom wall 314.

In the terminal fitting 3 having the above constitution, the caulking pieces 322 of the Al terminal 32 are folded at the edge on the side away from the bottom wall 321 in a direction closer to the bottom wall 321, and the sheath portion caulking pieces 316 of the terminal fitting main body 31 are folded at the edge on the side away from the bottom wall 314 in a direction closer to the bottom wall 314 by the crimping device 1, as shown in FIG. 6, for example. And the terminal fitting 3 is mounted at the terminal of the electric wire 4 by caulking the Al core wires 41 and the sheath portion 42 of the electric wire 4 with the caulking pieces 322 and 316 using the crimping device 1, as shown in FIG. 4.

The crimping device 1 comprises a device main body, not shown, a caulking portion 15 as caulking means, and an air cylinder 17 as a drive source, as shown in FIG. 6. The device main body is installed on the floor of the factory. The drive source may be a motor or a hydraulic type.

The caulking portion 15 comprises an anvil 19 as the shape and a crimper 27 as the shape. The anvil 19 is fixed to the device main body. The terminal fitting 3 is superposed (positioned) on the surface of the anvil 19.

The crimper 27 is opposed to the anvil 19 with a clearance, and supported on the device main body to be freely in or out of contact with the anvil 19. That is, the anvil 19 and the crimper 27 are provided to be freely in or out of contact with each other. The in or out of contact means approaching or leaving each other. The crimper 27 is provided with a groove 27*a* along the in or out of contact direction from the edge part on the side nearer to the anvil 19. This groove 27*a* is narrower in the width in a direction away from the anvil 19

In a state where the anvil 19 and the crimper 27 are out of contact with each other, the terminal fitting 3 and the Al core wires 41 of the electric wire 4 are positioned on the anvil 19. The anvil 19 and the crimper 27 approach each other to pinch the terminal fitting 3 and the Al core wires 41 of the electric wire 4 between them and caulk the caulking pieces 322, 315 and 316.

An air cylinder 17 as the drive source comprises a cylinder main body 28, and a rod 29 that can be freely projected from or retracted into the cylinder main body 28. The cylinder main body 28 is mounted on the device main body. The rod 29 is mounted on the crimper 27. The air cylinder 17 is arranged such that as the rod 29 is extended from the cylinder main body 28, the crimper 27 comes closer to the anvil 19, and if the rod 29 is contracted into the cylinder main body 28, the crimper 27 separates from the anvil 19.

A method for mounting the Al core wires 41 on the terminal fitting 3 having the above constitution will be described below. First of all, the Al terminal 32 is mounted on the anvil 19 in a state where the anvil 19 and the crimper 27 are separated, as shown in FIG. 7. And the bottom wall 314 between the pair of core wire caulking pieces 315 for the terminal fitting main body 31 is positioned on the bottom wall 321 between the pair of caulking pieces 322 of the Al terminal 32. Thereby, the bottom wall 321 of the Al terminal 32 covers the bottom wall 314 that is a part of the wire connection portion 312 of the terminal fitting main body 31 from the underside. Also, the pair of caulking pieces 315 of the terminal fitting main body 31 are pinched between the pair of caulking pieces 322 of the Al terminal 32.

Further, the Al core wires 41 of the electric wire 4 are positioned on the bottom wall 314 between the pair of core wire caulking pieces 315 of the terminal fitting main body 31. Thereby, the Al core wires 41 are arranged on the upper side of the bottom wall 314 that is a part of the wire connection portion 312 of the terminal fitting main body 31.

Thereafter, the rod 29 of the air cylinder 17 is extended. Then, the crimper 27 approaches the anvil 19, so that the pair of caulking pieces 322 are deformed along the inner side of the groove 27*a* provided in the crimper 27, as shown in FIG. 7. At the same time, the pair of core wire caulking pieces 315 are deformed as the pair of caulking pieces 322 are deformed. And the terminal fitting 3 is mounted on the electric wire 4 by pinching the terminal fitting 3 and the Al core wires 41 of the electric wire 4 between the anvil 19 and the crimper 27 and caulking the caulking pieces 322 and 316. Finally, the Al core wires 41 are crimped onto the terminal fitting 3 in tight contact with the bottom wall 314 and the caulking pieces 315 and 322, as shown in FIG. 5.

And the rod 29 of the air cylinder 17 is contracted, so that the anvil 19 and the crimper 27 are separated from each other to remove the terminal fitting 3 on the anvil 19. The Al terminal 32 is superposed on the anvil 19, the bottom wall 314 between the pair of core wire caulking pieces 315 for the terminal fitting main body 31 is positioned on the bottom wall 321 of the Al terminal 32, and the Al core wires 41 are positioned on the bottom wall 314 between the pair of core wire caulking pieces 315, whereby the terminal fitting 3 is mounted on the electric wire 4 in the same manner as the previous process.

With the above embodiment, the Al terminal 31 has the bottom wall 321 and one pair of caulking pieces 322 that are stood from the bottom wall 321 and caulked in a state where the bottom wall 321 covers the bottom wall 314 of the wire connection portion 312 with the Al core wires 41 arranged on the upper side from the underside.

Thereby, the Al terminal 32 made of Al or Al alloy can be crimped from outside the terminal fitting main body 31 made of copper or copper alloy, whereby the spring back of the terminal fitting main body 31 made of copper or copper alloy is suppressed by the Al terminal 32. The material of the Al terminal 32, Al or Al alloy, has a smaller spring back ratio than the material of the terminal fitting main body 31, copper or copper alloy.

Therefore, if the application of a crimping force by the crimping device 1 is stopped, the terminal fitting main body 31 greatly tends to return to its origin al shape. However, since the Al terminal 32 hardly returns to the origin al shape, the Al terminal 32 can suppress the spring back of the terminal fitting main body 31. Thereby, the Al core wires 41 made of Al or Al alloy for the electric wire 4 can be securely mounted by suppressing the contact resistance at the crimped part.

Since the Al core wires 41 made of Al or Al alloy and the Al terminal 32 have the roughly same spring back characteristic, it is possible to obtain a high contact pressure in the part where the Al terminal 32 and the Al core wires 41 are directly crimped.

With the above embodiment, the wire connection portion 312 of the terminal fitting main body 31 has the bottom wall 314 and the pair of core wire caulking pieces 315 stood from the bottom wall 314 and having lower height than the height H2 of the pair of caulking pieces 322. Thereby, the ends of the pair of caulking pieces 322 on the side away from the bottom wall 321 provided for the Al terminal 32 bite into the Al core wires 41 to form an interference fit structure, whereby the Al core wires 41 made of aluminum or aluminum alloy for the electric wire 4 can be securely mounted by suppressing the contact resistance at the crimped part.

Also, the terminal fitting main body 31 is provided such that the length L1 from one edge to the other edge of the pair of core wire caulking pieces 315 for the terminal fitting main body 31 may be ⅓ to ⅔ the length L2 from one edge to the other edge of the pair of caulking pieces 322 for the Al terminal 32. Thereby, it is possible to securely suppress spring back of the terminal fitting main body 31 made of copper or copper alloy, and increase the contact are a between the Al terminal 32 and the terminal fitting main body 31 and between the terminal fitting main body 31 and the Al core wires 41.

Figure 8:
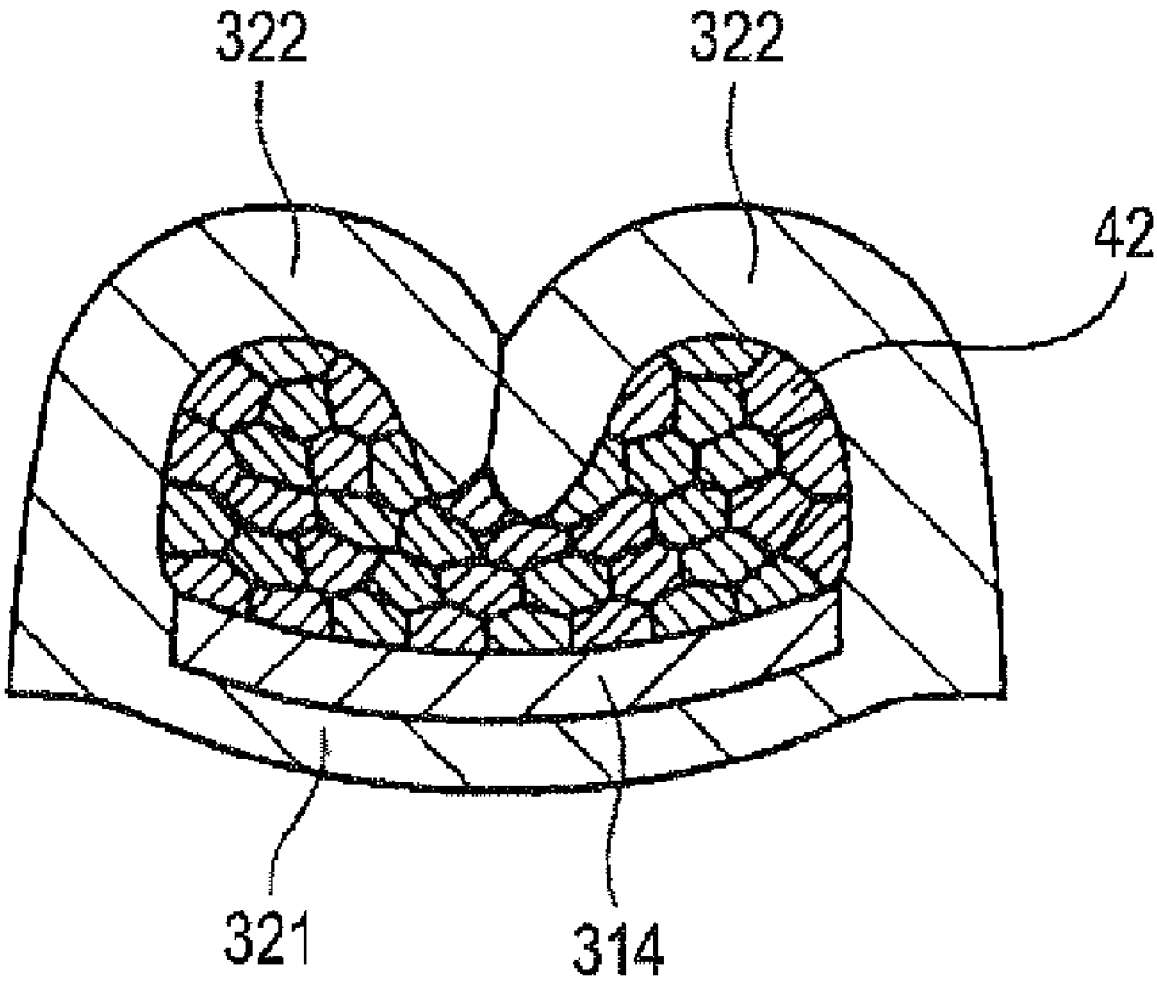
FIG. 8 is a cross-sectional view according to another embodiment.

With the above embodiment, the wire connection portion 312 of the terminal fitting main body 31 has the bottom wall 314 and the pair of core wire caulking pieces 315 stood from the bottom wall 314, but the invention is not limited thereto. For example, the wire connection portion 312 may not be provided with the pair of core wire caulking pieces 315, as shown in FIG. 8. However, if the pair of core wire caulking pieces 315 are provided as in the above embodiment, the contact are a between the Al terminal 32 and the terminal fitting main body 31 and between the terminal fitting main body 31 and the Al core wires 41 can be increased. And the secondary moment of are a and the section modulus structurally become larger values than the shape of the flat bottom wall 314 alone without the core wire caulking pieces 315, as shown in FIG. 8, improving the rigidity or strength of the crimped part, whereby the above embodiment is optimal.

Figure 9A:
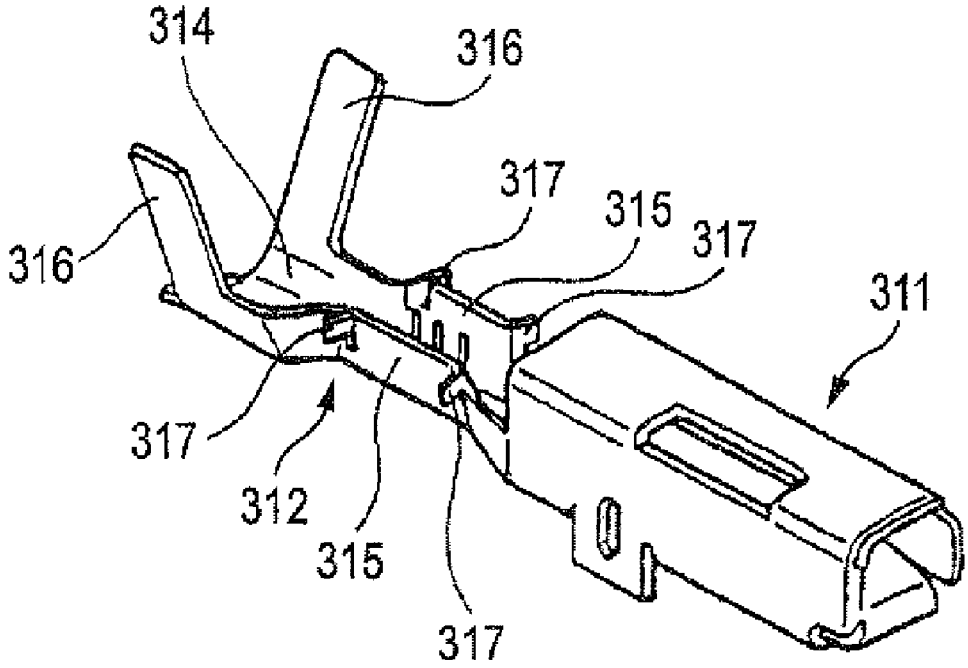
FIG. 9A is a perspective view of a terminal fitting main body according to another embodiment.
Figure 9B:
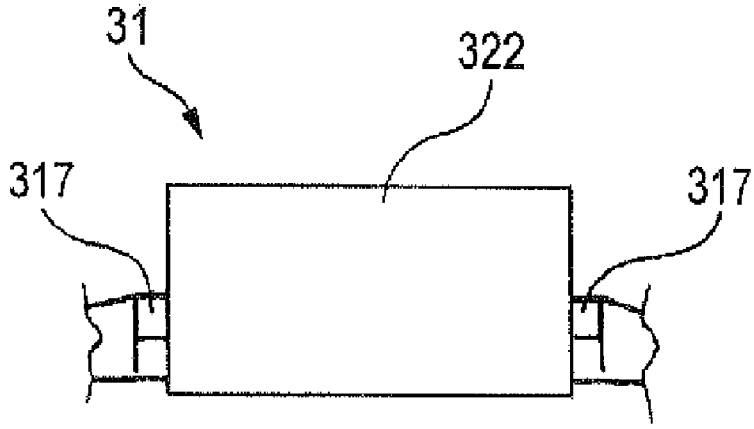
FIG. 9B is a partial side view in a state where the terminal fitting main body of FIG. 9A is positioned on the Al terminal.
Figure 10:
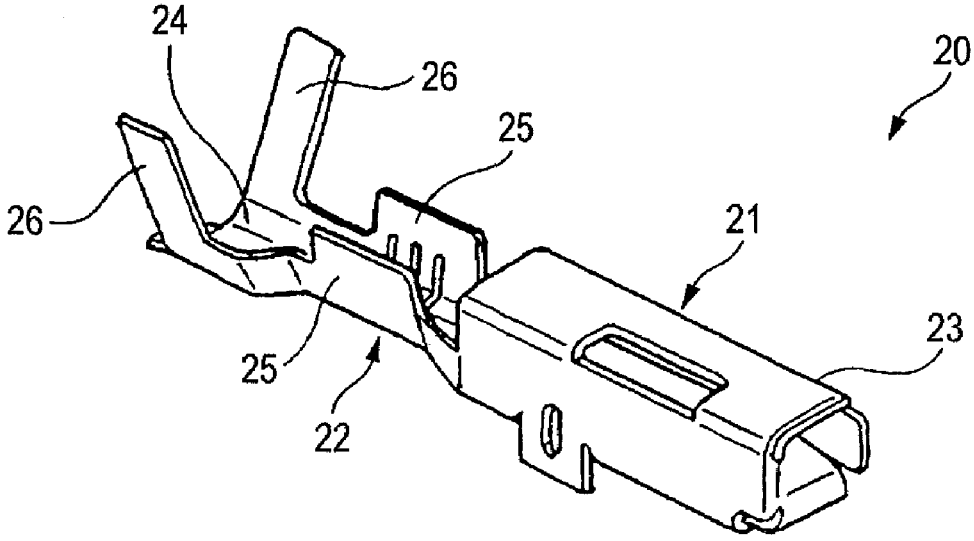
FIG. 10 PRIOR ART
FIG. 10 is a perspective view showing one example of the conventional terminal fitting.
Figure 11:
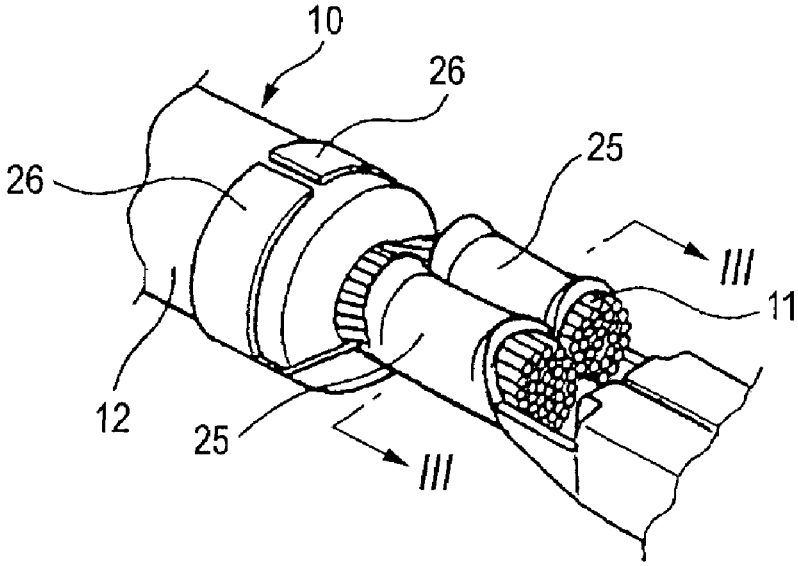
FIG. 11 PRIOR ART
FIG. 11 is a perspective view showing the terminal fitting mounted on the electric wire as shown in FIG. 10.
Figure 12:
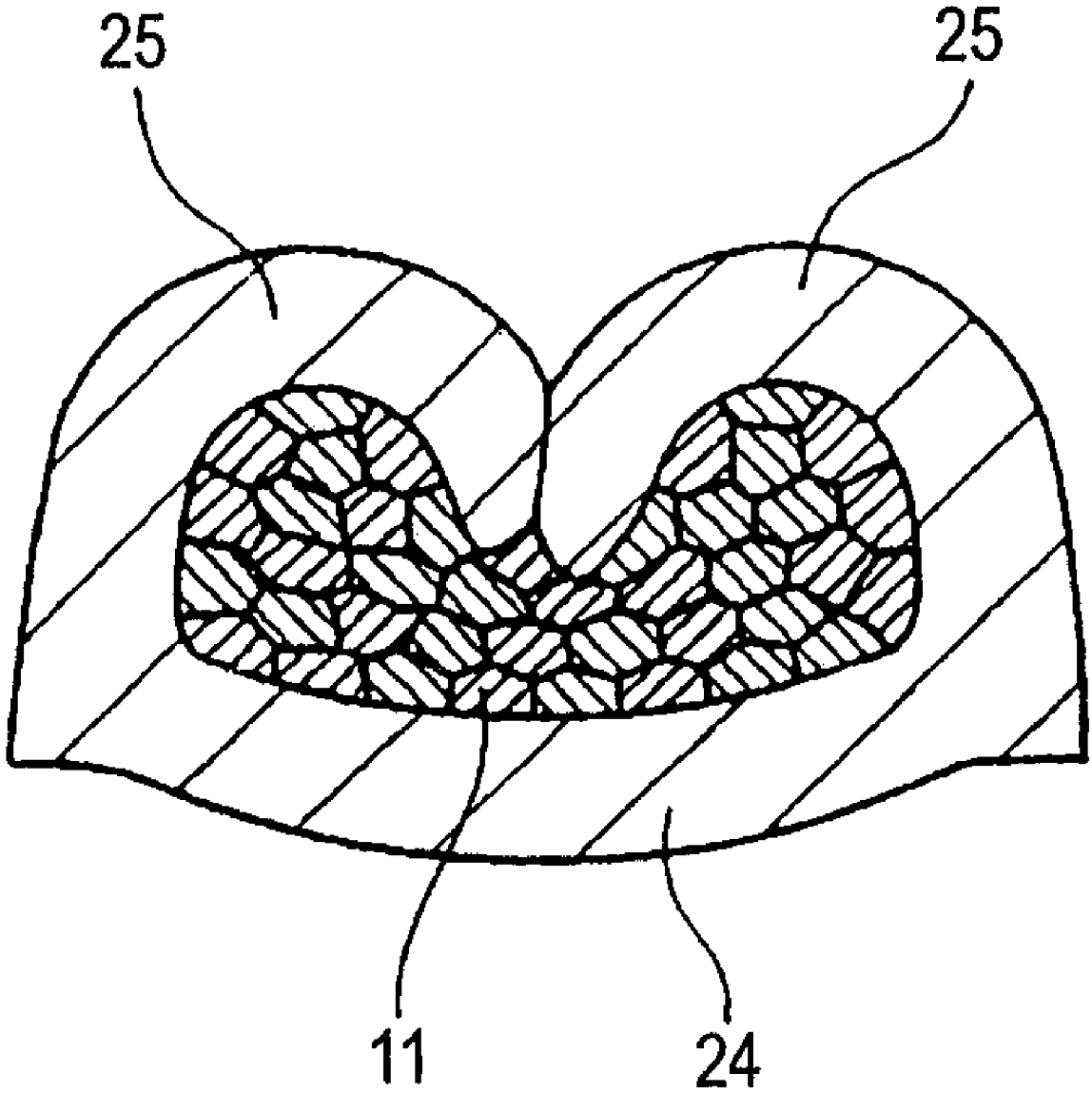
FIG. 12 PRIOR ART
FIG. 12 is a cross-sectional view of FIG. 11, taken along the line III-III.

Also, the terminal fitting main body 31 may be provided with the guide pieces 317 to prevent a misregistration in the longitudinal direction Y1 between the Al terminal 32 and the terminal fitting main body 31, as shown in FIG. 9. One pair of guide pieces 317 are provided for each of the pair of core wire caulking pieces 315. The pair of guide pieces 317 are provided at both ends of the core wire caulking piece 315 in the longitudinal direction. The guide pieces 317 are provided to project outwards from the outer side face of the core wire caulking piece 315. And the terminal fitting main body 31 is positioned on the Al terminal 32 to pinch the caulking pieces 322 of the Al terminal 32 between the pair of guide pieces 317, as shown in FIG. 9B.

The above embodiment only illustrates the typical mode of the invention, but the invention is not limited to the described embodiment. That is, various modifications may be made without departing from the spirit or scope of the invention.

What is claimed is:

1. A terminal fitting comprising:

a terminal fitting main body made of copper or copper alloy having a wire connection portion with top and bottom surfaces for connecting a core wire made of aluminum or aluminum alloy and an electric contact portion for connecting a mating terminal fitting; and an aluminum terminal made of aluminum or aluminum alloy for caulking the wire connection portion and the core wire, the aluminum terminal comprising a first bottom wall, and a first pair of caulking pieces that project to a height from the first bottom wall, wherein the aluminum terminal is positioned along the bottom surface of the wire connection portion and caulked such that the core wire is arranged on the top surface of the wire connection portion and the first bottom wall covers the wire connection portion of the terminal fitting from a lower side thereof.

2. The terminal fitting according to claim 1, wherein the wire connection portion includes a second bottom wall on which the core wire is arranged, and a second pair of caulking pieces that project from the second bottom wall to a height lower height than the height of the first pair of caulking pieces, and the aluminum terminal is caulked such that the second pair of caulking pieces are pinched between the first pair of caulking pieces.

3. A mounting method for mounting a core wire on a terminal fitting main body made of copper or copper alloy having a wire connection portion for connecting the core wire made of aluminum or aluminum alloy and an electric contact portion for connecting a mating terminal fitting, using an aluminum terminal made of aluminum or aluminum alloy having a first bottom wall and a first pair of caulking pieces projecting from the first bottom wall, including:

a step of arranging the core wire on an upper surface of the wire connection portion;

a step of orienting a lower surface of the wire connection portion with the first bottom wall of the aluminum terminal; and a step of caulking the first pair of terminal caulking pieces such that the core wire is secured within the wire connection portion of the terminal fitting.

* * * * *